US006860970B2

(12) United States Patent
Ampulski

(10) Patent No.: US 6,860,970 B2
(45) Date of Patent: Mar. 1, 2005

(54) PATTERNED PAPER MACHINE CLOTHING

(75) Inventor: Robert Stanley Ampulski, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 34 days.

(21) Appl. No.: 10/373,247

(22) Filed: Feb. 24, 2003

(65) Prior Publication Data

US 2003/0145970 A1 Aug. 7, 2003

Related U.S. Application Data

(63) Continuation-in-part of application No. PCT/US01/27215, filed on Aug. 31, 2001.

(60) Provisional application No. 60/230,501, filed on Sep. 6, 2000.

(51) Int. Cl.[7] ..... D21F 7/12; D21F 5/04; B32B 5/02

(52) U.S. Cl. ..... 162/359.1; 162/375; 162/902; 34/116; 34/121; 442/220

(58) Field of Search ..... 162/109–117, 306, 162/348, 358.2, 358.4, 360, 361, 900–904, 359.1, 375; 139/383 A, 425 A; 34/11, 116, 123; 442/218–220, 281, 286, 43

(56) References Cited

U.S. PATENT DOCUMENTS 4,967,489 A 11/1990 Autio
5,077,116 A * 12/1991 Lefkowitz ..... 428/141
5,114,777 A * 5/1992 Gaisser ..... 428/137
5,462,642 A * 10/1995 Kajander ..... 162/116
5,535,527 A 7/1996 Virta et al.
5,837,103 A * 11/1998 Trokhan et al. ..... 162/358.2
5,849,395 A * 12/1998 Valentine et al. ..... 428/195.1
6,071,837 A * 6/2000 Crook ..... 442/268
6,103,062 A * 8/2000 Ampulski et al. ..... 162/109
6,436,240 B1 * 8/2002 Jeffrey ..... 162/358.2

FOREIGN PATENT DOCUMENTS

WO WO 00/09308 2/2000

OTHER PUBLICATIONS

International Search Report for PCT/US01/27215, date of mailing Jan. 31, 2002.

* cited by examiner

*Primary Examiner*—Steven P. Griffin
*Assistant Examiner*—Eric Hug
(74) *Attorney, Agent, or Firm*—David M. Weirich; Ken K. Patel; Steven W. Miller

(57) ABSTRACT

A papermaking belt for use in making paper. The papermaking belt may be used in conjunction with a single-wire draw or twin-wire draw of a papermaking machine. The papermaking belt includes a woven reinforcing element and a patterned framework. The framework defines either or both faces of the papermaking belt. The pattern of the framework is independent of the weave of the reinforcing element.

9 Claims, 3 Drawing Sheets

PATTERNED PAPER MACHINE CLOTHING

CROSS REFERENCE TO RELATED APPLICATIONS

This application is a continuation-in-part of International Application PCT/US01/27215, with an international filing date of Aug. 31, 2001, which claims benefit of U.S. Provisional Application No. 60/230,501, filed Sep. 6, 2000.

FIELD OF INVENTION

This invention relates to clothing for papermaking machinery, and particularly clothing having differential intensive properties.

BACKGROUND OF THE INVENTION

Conventional papermaking requires the removal of significant amounts of water. The final water removal is typically done by evaporative drying. A conventional papermaking machine has a dryer section with a plurality of drying cylinders. The paper web to be dried is guided in contacting relationship through the plurality of cylinders. The cylinders may be arranged in two or more staggered rows, so that the paper web assumes a serpentine path.

In the art, a single-wire draw may be used, particularly at the beginning of the multi-cylinder dryer. In a single-wire draw, the drying wire is arranged to support the web as it moves from one cylinder to a successive cylinder.

Also, twin-wire draws are known in the art. In a twin-wire draw, the paper web has an open draw when it moves from one cylinder to a successive cylinder. Also known in the art is a Pistol-Grip draw. In a Pistol-Grip draw, the top wire of one cylinder section is wound below the bottom cylinder of the next cylinder section, and the web is supported by the top wire to the next top cylinder.

Examples of papermaking machinery can be found in U.S. Pat. No. 4,888,883, iss. Dec. 26, 1989 to Kerttula; U.S. Pat. No. 5,046,266, iss. Sep. 10, 1991 to Autio; U.S. Pat. No. 5,475,934 iss. Dec. 19, 1995 to Eskelinen et al.; U.S. Pat. No. 5,495,678, iss. Mar. 5, 1996 to Ilmarinen et al.; U.S. Pat. No. 5,535,527, iss. Jul. 16, 1996 to Virta et al.; U.S. Pat. No. 5,537,755, iss. Jul. 23, 1996 to Kotitschke; U.S. Pat. No. 5,539,999, iss. Jul. 30, 1996 to Kuhasalo; U.S. Pat. No. 5,560,123, iss. Oct. 1, 1996 to Eskelinen; U.S. Pat. No. 5,572,801, iss. Nov. 12, 1996 to Ahokas et al.; U.S. Pat. No. 5,666,741, iss. Sep. 16, 1997 to Bubik et al.; and U.S. Pat. No. 6,105,277, iss. Aug. 22, 2000 to Lindberg et al., incorporated herein by reference.

The paper machine clothing generally serves a variety of competing purposes. It can support the web without separation; it should allow adequate permeability for transport of water to be removed from the web and it should provide contact of the web against the drying cylinders, while also contacting the reversing cylinders. Attempts have been made in the art to provide suitable drying fabrics. For example, belt-like material having selected permeabilities are known. The selected permeabilities are provided by varying the spacing of the machine direction yarns, the diameter of the machine direction yarns, or adding chemical treatment in the spaces between the machine direction yarns.

In yet another attempt in the art, the clothing has a controlled void volume. The void volume is controlled by providing a multi-layer fabric, a synthetic, polymeric thermoplastic resin foam may fill the void spaces to control the void volume.

In yet another embodiment, to reverse the adverse effects of over-pressure on the sheet at the outer face of a dryer fabric, void spaces at the fabric-cylinder interface receive boundary air compressed between the paper machine clothing and the cylinder. The void space forming surface may include spaced parallel ribs defining grooves therebetween. The grooves reduce the rate and extent to which boundary air moves into the reducing space between the fabric and cylinder is compressed. This has a corresponding effect on reducing the amount of air forced through the fabric.

In yet another attempt in the art, the dryer fabric includes a plurality of spiral coils extending in the machine direction. Adjacent coils are intermeshed and held together by a hinge yarn. This arrangement is said to reduce occurrences of slack edges. Slack edges in the dryer fabric do not fully press the paper sheet against the cylinder, causing different drying rates to occur in the machine direction. This results in a non-uniform moisture profile across the sheet.

Examples of the foregoing attempts in the art may be found in U.S. Pat. No. 3,867,766, iss. Feb. 25, 1975 to Wagner; U.S. Pat. No. 4,224,372, iss. Sep. 23, 1980 to Romanski; U.S. Pat. No. 4,364,421, iss. Dec. 21, 1982 to Martin; U.S. Pat. No. 4,813,156, iss. Mar. 21, 1989 to Ashworth et al.; and U.S. Pat. No. 4,857,391, iss. Aug. 15, 1989 to Westhead, incorporated herein by reference.

However, the foregoing attempts in the art have not proven entirely successful. For example, woven drying clothing is limited to the patterns which are provided by a repeatable and stable weave. Unlimited patterns are not feasible. Only limited geometries of grooves may be provided to handle the entrained air. The present invention overcomes these disadvantages and provides greater flexibility and options in determining the geometry of the paper machinery clothing.

Additionally, paper machine clothing is known to experience wear during the papermaking process. Such wear shortens the life of the paper machine clothing, increasing the manufacturing costs. Wear of paper machine clothing is attributed to the temperature extremes which occur in papermaking, the two-way bending which occurs as the clothing passes over drying rolls and reversing rolls, as well as the friction against the rolls and drag across vacuum boxes.

Various attempts have been made in the art to mitigate the wear of paper machine clothing which is inherent in the papermaking process. For example, clothing having stacked warps has become common. In a stacked warp arrangement, oftentimes a first layer of lower, or machine-contacting, warp threads is provided. Also, a second layer of upper, or paper-contacting, warps is provided. The two layers of warps are interwoven by weft yarns. The lower layer of warps may be of larger diameter to provide stability and wear-resistance. The upper layer of warps may be of finer diameter to provide a finer surface which provides more consistent and uniform support for the paper web. An example of stacked warps is found in U.S. Pat. No. 5,114,777, issued to Gaisser.

Yet another attempt in the art is to provide warp and/or weft yarns of noncircular cross-section. Particularly, the yarns of the paper machine clothing may be rectangular, having a greater dimension in the width direction than in the height or Z-direction. This geometry provides more area in contact with the papermaking machinery, thus reducing the contact stresses at any particular point in the yarn. Additionally, noncircular, or rectangular, shaped yarns provide the benefit that more area is presented to the paper side of the paper machine clothing as well. By presenting more area to the paper machine side of the clothing, more contact against the drying cylinders occurs. By providing more contact of the paper against the drying cylinder, more rapid and uniform drying of the paper web is possible.

Accordingly, the art has shown considerable need for a fabric which presents high contact area to the paper to be dried thereupon. Further, there is a need for a papermaking fabric having such high contact area without sacrificing permeability. Finally, there is a need for such a fabric which provides relatively uniform pressure against all regions of the paper to be dried thereupon.

One of skill will recognize that the problems of wear of the paper machine clothing is not limited to production of conventional or hard grades of paper. Such wear also occurs when producing tissue and corrugated grades of paper as well.

However, foregoing attempts to reduce wear of the paper machine clothing have not been entirely successful. For example, stacked warp paper machine fabrics are more expensive than single layer fabrics. Also, such fabrics are prone to sleaziness. Rectangular-shaped warps are not amenable to all types of weaves, particularly, high open area weaves which may be desirable for certain types of papermaking, such as through air drying, useful for making tissue paper. Rectangular cross section filaments for a dryer fabric are illustrated in Statutory Invention Registration H1073, published Jul. 7, 1992 in the name of Hsu, incorporated herein by reference.

The art has also shown considerable need for a way to reduce the wear of paper machine clothing, without constraining the type of weave or type of yarns used for the paper machine clothing. Moreover, there is considerable need in the art for a way to reduce wear that is applicable to any type of clothing, including forming wires, or weave. Further, it would be desirable that such a way to reduce the wear of paper machine clothing reduce the sleaziness of the clothing without affecting its paper-contacting surface.

SUMMARY OF THE INVENTION

The invention comprises a papermaking belt usable for making hard grades of paper. The papermaking belt has two mutually opposed faces, a paper-contacting face and a machine-contacting face. The papermaking belt has a reinforcing element. The reinforcing element comprises woven filaments. The woven filaments are disposed in the warp and weft directions. The papermaking belt further has a framework. The framework has a pattern independent of the weave found in the reinforcing element. The pattern defines at least one of the paper-contacting face and machine-contacting face of the papermaking belt.

The pattern may comprise a photosensitive resin. Further, the framework may comprise a photosensitive resin. Further, the pattern may comprise an essentially continuous network or any other XY pattern which is desired.

DETAILED DESCRIPTION OF THE INVENTION

Figure 1:
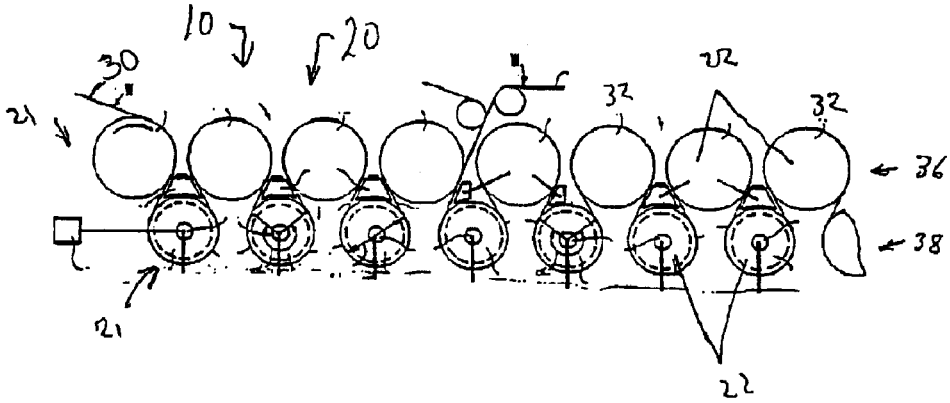
FIG. 1 is a fragmentary vertical elevational view of a dryer section in a single-wire paper machine.

Referring to FIG. 1, a dryer section 10 in a single-wire draw papermaking machine 20 is illustrated. The dryer groups 21 comprise drying cylinders 32 heated by known means, such as steam. The web is pressed against the heated cylinder faces by means of a dryer fabric 30. In a single-wire draw machine, the web runs from one drying cylinder to another cylinder. Successive cylinders 22 are typically disposed in two rows placed at different elevations. The same dryer fabric 30 spans the gap between the rows of cylinders 22, although it is to be recognized that more than one dryer fabric 30 may be used and spaced in the machine direction from other fabrics.

Referring in more detail to FIG. 1, the dryer groups 21 comprise two substantially horizontal rows of steam-heated dryer cylinders 32. Dryer fabric 30 guides a paper web W on an outer face of the cylinders 22 through respective dryer groups 21. The dryer fabric 30 presses the web against the outer faces of the heated cylinders 22 so that evaporative drying occurs.

Underneath the rows of drying cylinders 32 are nonheated reversing cylinders 34 or guide rolls. The reversing cylinders 34 may have suction sectors or equivalent arrangements so that the web remains on the outer face of the drying wire at high speeds.

Figure 2:
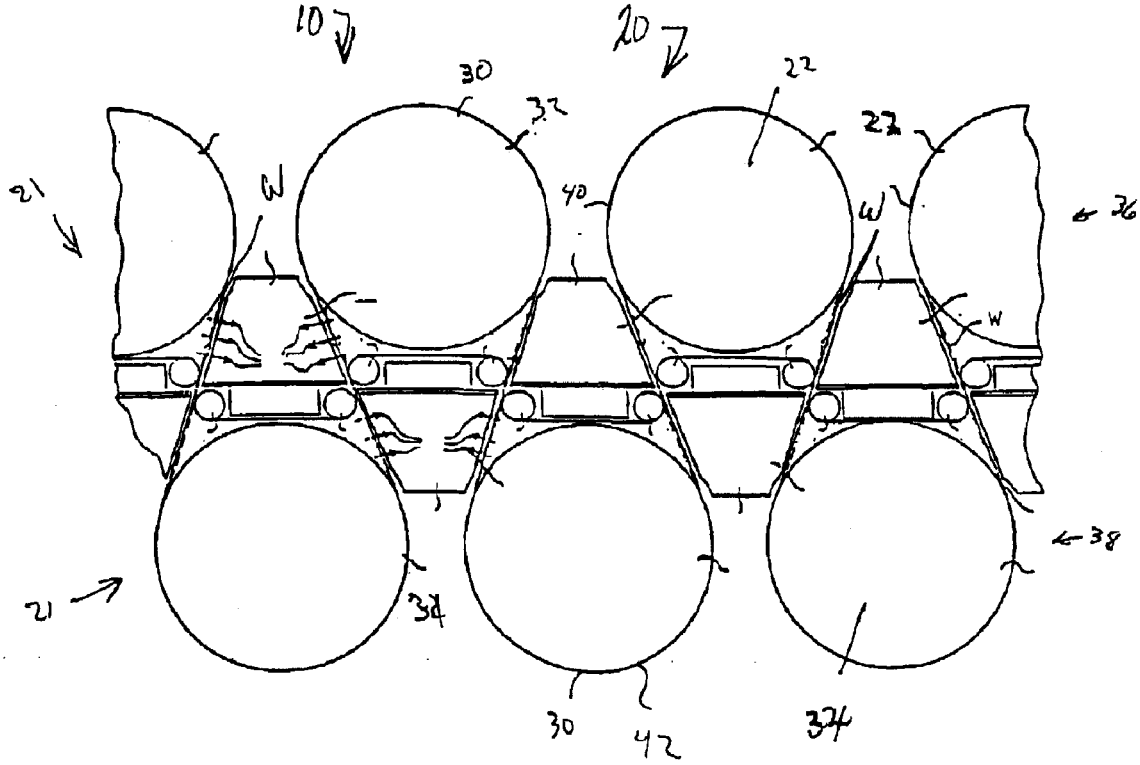
FIG. 2 is a fragmentary vertical elevational view of a dryer section in a twin-wire paper machine.

Referring to FIG. 2, a multi-cylinder drying section of a papermaking machine 20 is illustrated. The multi-cylinder dryer section 10 has a plurality of upper drying cylinders 36 and lower drying cylinders 38. The paper web W to be dried is passed in succession between upper and lower cylinders 36, 38. The paper web W is in direct contact with each drying cylinder. Preferably, the paper web W contacts each drying cylinder over a sector of at least, and preferably greater than 180 degrees. The dryer section 10 comprises an upper dryer fabric 40 and a lower dryer fabric 42, each being arranged to press the paper web W against its respective drying cylinders 32. The upper and lower dryer fabrics 40, 42 may be guided by guide rolls. Also, a dryer fabric 30 transfer device comprising a section box and auxiliary rolls may be utilized. Of course, it is to be realized that various section boxes may be added or omitted as desired. Further, any number of upper and lower drying cylinders 36, 38 in the plurality may be utilized as desired.

Figure 3A:
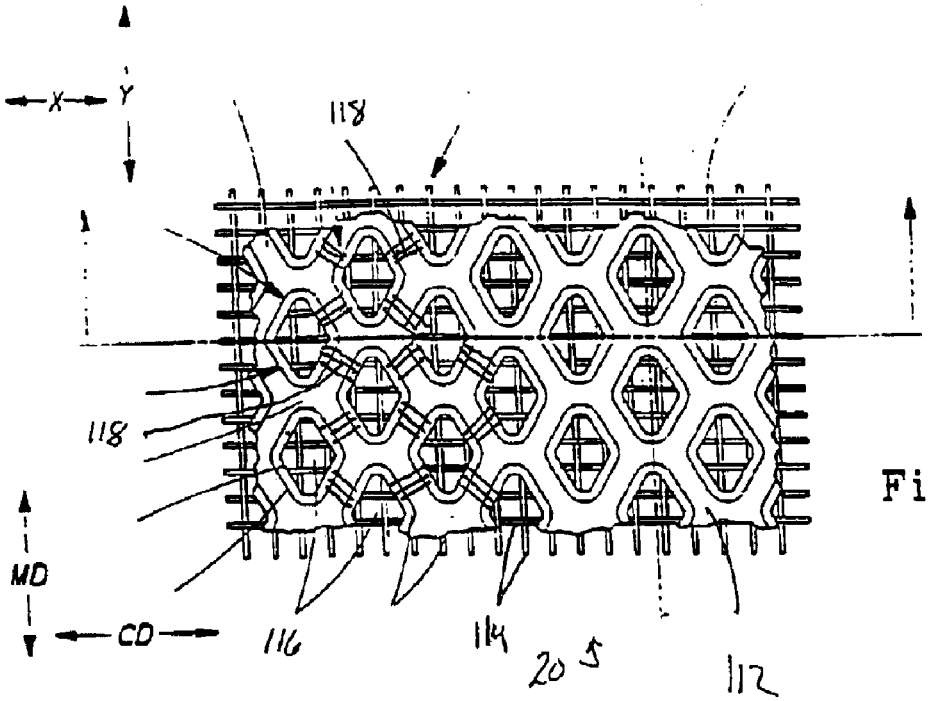
FIG. 3A is a fragmentary top plan view of paper machine clothing according to the present invention.
Figure 3B:
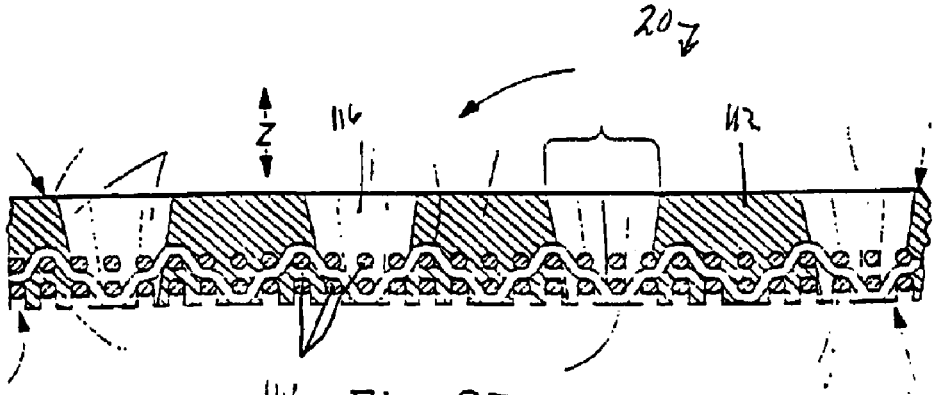
FIG. 3B is a fragmentary vertical sectional view of paper machine clothing according to FIG. 3A.

Referring to FIGS. 3A and 3B, the dryer fabric 30 according to the present invention may generally be considered a papermaking belt 25. The papermaking belt 25 may be used for, or in combination with, a cylinder drying section of a papermaking machine 20. Specifically, the papermaking belt 25 may be usable in, or in combination with, a single-wire draw or a twin-wire draw papermaking machine 20. The belt 25 according to the present invention is preferably macroscopically monoplanar. The plane of the belt 25 defines the XY directions. Perpendicular to the XY directions and plane of the belt 25 is the Z-direction of the belt 25.

Likewise, the paper web W made on the belt 25 according to the present invention may be thought of as macroscopically planar and lying in an XY plane. Perpendicular to the XY directions and plane of the paper web W is the Z-direction of the paper web W. Examples of paper web W are considered to be a printing kraft, newsprint, linerboard or writing grade of paper web W. Collectively, these grades of paper are referred to hereinbelow as "hard" grades of paper. Such paper will typically have a basis weight of 20 to 450 and more typically 30 to 300 grams per square meter.

The belt 25 comprises two primary components: a framework 112 and a reinforcing element 114. The framework 112 may comprise a molded or extruded thermoplastic or pseudo-thermoplastic material and preferably comprises a cured polymeric photosensitive resin. The reinforcing element 114 may comprise a woven fabric as is known in the art. The framework 112 and belt 25 have a first surface which defines the paper web W contacting side of the belt 25 and an opposed second surface oriented towards the papermaking machine 20 on which the belt 25 is used. The framework 112 may optionally have synclines 118 therein, as further described below.

The framework 112 is disposed on and defines the first surface of the belt 25. Preferably the framework 112 defines a predetermined pattern, which may, in certain embodiments, imprint a like pattern onto the paper web W of the invention. Deflection conduits 116 extend between the first surface and the second surface. The framework 112 borders and defines the deflection conduits 116. One preferred, and typical geometry comprises a framework 112 which defines an essentially continuous network (hereinafter a continuous framework 112) and discrete isolated (hereinafter discontinuous) deflection conduits 116.

The framework 112 may present a relatively high surface area to the paper web W thereon. The relatively high surface area provides two benefits: First, in a single-wire papermaking machine 20, the high surface area provides more contact with the paper web W against the drying cylinders 32. This increases conduction of heat from the face of the cylinders 22 to the paper web W and provides increased drying efficiency. Additionally, the high contact area provides for more uniform application of pressure of the paper web W against the drying cylinder, thereby providing a more consistent and uniform appearance throughout the sheet.

Preferably, the framework 112 provides a surface area of at least 30%, more preferably at least 50%, and still more preferably at least 70%, and even more preferably at least 90% of the surface area of the belt 25. One of skill will recognize that as the surface area increases, the amount of contact and uniformity of the imprint against the drying cylinders 32 will likewise increase. However, the present invention provides the advantage that, for a given permeability, any desired imprint fabric and distribution of surface area against the paper web W to be dried is attainable.

In contrast to the belts 25 limited by the weaves and technology of the prior art, the belt 25 according to the present invention decouples the fabric permeability and its imprint area. Typically, in the prior art, to make a papermaking belt 25 more permeable, one had to use a coarser weave. In a coarser weave, the filaments may be spaced apart on a relatively greater pitch. The diameter of the filaments may change. The present invention allows the permeability to be controlled by the framework 112, independent of the diameter, pitch and type of weave selected for the reinforcing element 114. This provides one of ordinary skill with greater latitude in selecting and making papermaking belts 25 for use in making hard grades of paper web W. Another potential benefit of the present invention is that as the amount of framework 112 increases, the sleaziness of the belt 25 can be reduced in an inversely proportional relationship.

In a twin-wire draw papermaking machine 20, the increased contact area with the face of the drying cylinder provides the benefits noted above relative to single-wire draw papermaking machines 20. Additionally, in a twin-wire draw, as the backside of the belt 25 contacts the outer face of the opposite row of drying cylinders 32, further benefits can be realized. For example, the permeability of the belt 25 may be optimized to reduce the entrainment of air between the belt 25 the drying cylinder. Reducing the entrainment of air between the backside of the belt 25 and the drying cylinder likewise reduces the tendency of the paper web W to lift off of the belt 25.

Additionally, in the twin-wire draw or the single-wire draw machine, the provision of the framework 112 against the backside of the belt 25 presents an increased surface area over which friction and wear against the rotating elements of the paper machine may be spread. This provides more uniform stress distribution and increased belt 25 life.

Figure 4:
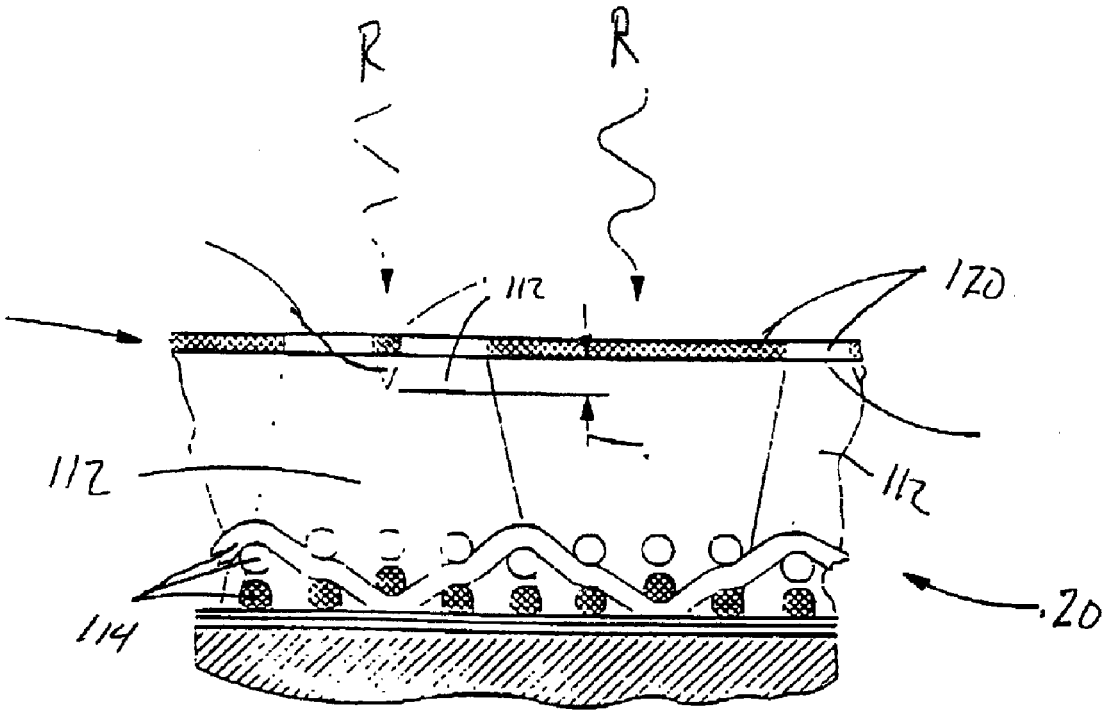
FIG. 4 is a fragmentary schematic side elevational view of a mask and liquid resin used to make a belt according to the present invention and showing the incident radiation upon the mask being blocked by an opaque region in the mask.

Referring to FIG. 4, the belt 25 may be made as follows. A photosensitive, and preferably photo-curable, resin is provided. The resin is cast onto the reinforcing element 114 of the papermaking belt 25. The resin is cast in liquid form and metered to the desired thickness. Preferably some of the resin extends above the top surface of the framework 112, although it is not necessary as described below. Alternatively, a thermally curable resin may be utilized.

A mask 120 having opaque and transparent areas is placed over the resin. Curing radiation R of the proper wavelength is applied through the transparent areas of the mask 120. Portions of the resin immediately below and adjacent the transparent areas of the mask 120 are cured. Regions of the curable resin disposed beneath the opaque areas are not cured and are later washed or vacuumed away. The distribution of transparent and opaque areas in the mask 120 determines the pattern of the resulting framework 112 in the belt 25.

The XY position of the framework 112 is determined by the transparent regions of the mask 120. The Z-direction height of the framework 112 is determined by the depth of the resin prior to curing.

Instead of a curable resin as described above, epoxy moldable clay or putty may be applied and externally introduced to form the framework 112. Alternatively, bicomponent dual-melting point filaments may be used for the papermaking belt 25. To make a papernaking belt 25 of the present invention, first the belt 25 is woven from the bicomponent filaments. The belt 25 is then disposed on a flat, rigid, horizontal surface with the backside downwardly oriented. Heat is locally applied but limited to the regions desired to be melted and form the framework 112. The localized heat melts the sheets of the filaments at XY positions coincident the desired portions of the framework 112. The melted sheet material flows downward toward the horizontal support surface. The horizontal support surface acts as a heat sink, allowing the sheet material to refreeze and form a portion of the framework 112. Additionally, the framework 112 may be printed or extruded onto the reinforcing element 114. Suitable methods for accomplishing the addition of a framework 112 to a reinforcing element 114 are found in commonly assigned U.S. Pat. No. 6,149,849, issued Nov. 21, 2000 to Ampulski, and U.S. Pat. No. 6,099,781, issued Aug. 8, 2000 to Ampulski.

Referring back to FIGS. 3A and 3B, suitable belts 25 having a continuous framework 112 and discontinuous deflection conduits 116 are illustrated in commonly assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No.

5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 5,679,222 issued Oct. 21, 1997 to Rasch et al.; U.S. Pat. No. 5,714,041 issued Feb. 3, 1998 to Ayers et al.; U.S. Pat. No. 5,948,210, issued Sep. 7, 1999 to Huston; 5,954,097, issued Sep. 21, 1999 to Boutilier; U.S. Pat. No. 5,972,813, issued Oct. 26, 1999 to Polat et al.; 6,010,598, issued Jan. 4, 2000 to Boutilier et al.; and, U.S. Pat. No. 6,110,324, iss. Aug. 29, 2000 to Trokhan et al., the disclosures of which are incorporated herein by reference.

The second surface of the belt 25 is the machine contacting surface of the belt 25. The second surface may have a backside network with passageways therein which are distinct from the deflection conduits 116. The passageways provide irregularities in the texture of the backside of the second surface of the belt 25. The passageways allow for air leakage in the X-Y plane of the belt 25, which leakage does not necessarily flow in the Z-direction through the deflection conduits 116 of the belt 25.

The second primary component of the belt 25 according to the present invention is the reinforcing element 114. The reinforcing element 114, like the framework 112, has a paper web W facing side and a machine facing side opposite the paper web W facing side. The reinforcing element 114 is primarily disposed between the opposed surfaces of the belt 25 and may have a surface coincident the backside of the belt 25. The reinforcing element 114 provides support for the framework 112. The reinforcing element 114 is typically woven, as is well known in the art. The reinforcement is usually woven with warp and weft filaments, and may comprise a single layer or be of a multi-layer construction.

If desired, the belt 25 may be executed as a press felt, as is commonly used in conventional drying, and is well known in the art. A suitable press felt for use according to the present invention may be made according to the teachings of commonly assigned U.S. Pat. No. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. U.S. Pat. No. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; U.S. Pat. No. 5,861,082 issued Jan. 19, 1999 to Ampulski et al.; U.S. Pat. No. 5,871,887 issued Feb. 16, 1999 to Trokhan et al.; U.S. Pat. No. 5,897,745 issued Apr. 27, 1999 to Ampulski, et al.; U.S. Pat. No. 5,904,811 issued May 18, 1999 to Ampulski et al.; and U.S. Pat. No. 6,051,105, issued Apr. 18, 2000 to Ampulski, the disclosures of which are incorporated herein by reference. In an alternative embodiment, the belt 25 may be executed as a press felt according to the teachings of U.S. Pat. No. 5,569,358 issued Oct. 29, 1996 to Cameron.

If desired, in a variant embodiment, the belt 25 according to the present invention may further comprise synclines 118 in the essentially continuous network comprising the framework 112. The synclines 118 intercept the paper web W facing side of the framework 112 and extend in the Z-direction into the framework 112. The "synclines" 118 are surfaces of the framework 112 having a Z-direction vector component extending from the first surface of the belt 25 towards the second surface of the belt 25. The synclines 118 do not extend completely through the framework 112, as do the deflection conduits 116. Thus, the difference between a syncline 118 and a deflection conduit 116 may be thought of as the deflection conduit 116 represents a through hole in the framework 112, whereas a syncline 118 represents a blind hole, fissure, chasm, or notch in the framework 112. The synclines 118 in the framework 112 of the present invention allow for lateral leakage on the top side, i.e. the first surface, of the framework 112 between the felt 10 and the paper web W.

The imprinting surface may comprise one or a plurality of alternating synclines 118 and lands 34 respectively. As used herein, a "land" 34 refers to the surface of the framework 112 which is coincident the paper web W contacting side of the belt 25 and disposed between the synclines 118.

The belt 25 imprints the paper web W against the drying cylinders 32 of a single-wire or twin-wire drying section of a papermaking machine 20. More particularly, the portions of the framework 112 which contact the paper web W imprint and increase the density of such paper web W. Conversely, deflection conduits 116 do not imprint the paper web W.

However, the paper web W may be de-densified as it passes over any of the aforementioned vacuum boxes or transfer devices. Such de-densification occurs due to deflection of the paper web W into the deflection conduits 116. It would be apparent to one of ordinary skill that as the paper web W passes over more and more drying cylinders 32, the fibers have less mobility, and thus will encounter less deflection into the deflection conduits 116. Accordingly, the amount of de-densification which occurs is prophetically sensitive to the placement of the vacuum boxes among and between the various drying cylinders 32.

Furthermore, an intermediate density region of the paper web W may occur. For example, the syncline 118 neither densifies nor de-densifies the paper web W. Since the synclines 118 do not imprint the paper web W against the drying cylinder, no densification occurs. Since a vacuum cannot be drawn through the syncline 118, de-densification cannot occur. Accordingly, the regions of the paper web W registered with the syncline 118 will have a density intermediate that of regions registered with the lands 134 of the framework 112 and the deflection conduits 116.

Instead of being essentially continuous and forming discrete isolated deflection conduits 116, a semicontinuous framework 112 may be made and employed according to the teachings of commonly assigned U.S. Pat. No. 5,628,876, iss. May 13, 1997 to Ayers et al. and U.S. Pat. No. 5,714,041, iss. Feb. 13, 1998 to Ayers et al., which patents are incorporated herein by reference. A semicontinuous framework 112 extends in one direction throughout the belt 25. A semicontinuous framework 112 may be straight, sinusoidal, or otherwise undulating. Likewise, the framework 112 may be provided in a pattern which is discrete, i.e., discontinuous.

Referring again to FIG. 4, as disclosed in the aforementioned patents incorporated herein by reference, the synclineous belt 25 according to the present invention may be made by curing a photosensitive resin through a mask 120 as described above. The mask 120 has first regions 42 which are transparent to actinic radiation R (indicated by the arrows) and second regions 44 which are opaque to the actinic radiation R. The regions 42 in the mask 120 which are transparent to the actinic radiation R will form like regions in the photosensitive resin which cure and become the framework 112 of the belt 25 according to the present invention. Conversely, the regions 44 of the mask 120 which are opaque to the actinic radiation R will cause the resin in the positions corresponding thereto to remain uncured. This uncured resin is removed during the beltmaking process and does not form part of the belt 25 according to the present invention.

In order to form the synclines 118 in the belt 25 according to the present invention, the mask 120 may have opaque lines 46 corresponding to the desired synclines 118. The opaque lines 46 are sufficiently narrow in width that radiation R incident thereupon at any angle nearly perpendicular to the belt 25 is blocked from penetrating the belt 25 to any depth 30. That portion of resin centered under and immediately below the opaque line 46 will not receive radiation R at any depth 30. However, as the angle of incidence of the radiation R decreases (becomes less perpendicular and more parallel to the surface), the depth 30 of the syncline 118 correspondingly decreases.

It will be apparent to one of ordinary skill that as the desired depth 30 of the synclines 118 increases, the width of the opaque line 46 should likewise increase. Of course, the opaque lines 46 may be applied in any desired pattern corresponding to the pattern desired for the synclines 118. For the embodiments described herein, having a syncline 118 with a maximum depth 30 of 0.2 to 75 mils., an appropriate opaque line 46 width is from 0.001 inches to 0.040 inches, depending upon the perpendicularity of the radiation R incident upon the belt 25 and the amount of curing energy imparted to the resin.

The paper web W of the present invention may have three primary regions if made using a fabric having the aforementioned system of lands 134, deflection conduits 116 and synclines 118. A first region 122 which may be imprinted and comprises a high density region, a second region 124 which comprises deflected region, and a third region 126 which corresponds to the synclines 118 and the framework 112 during papermaking. It is believed that all three regions have generally equivalent basis weights. However, the highest density region will be the imprinted region, corresponding to the position of the lands 134 of the framework 112 of the belt 25. The lowest region will be those corresponding in position to the deflection conduits 116. The regions of the paper web W corresponding to the synclines 118 and the papermaking belt 25 will have an intermediate density. This is illustrated in Table I for various patterns of belts 25.

TABLE I

| High Density Region | Med. Density Region | Low Density Region |
|---|---|---|
| Discontinuous | Discontinuous | Discontinuous |
| Discontinuous | Discontinuous | Semicontinuous |
| Discontinuous | Discontinuous | Continuous |
| Discontinuous | Semicontinuous | Discontinuous |
| Discontinuous | Semicontinuous | Semicontinuous |
| Discontinuous | Continuous | Discontinuous |

TABLE I-continued

| High Density Region | Med. Density Region | Low Density Region |
|---|---|---|
| Semicontinuous | Discontinuous | Discontinuous |
| Semicontinuous | Discontinuous | Semicontinuous |
| Semicontinuous | Semicontinuous | Discontinuous |
| Semicontinuous | Semicontinuous | Semicontinuous |
| Continuous | Discontinuous | Discontinuous |

Likewise, the three regions of the paper web W according to the present invention may be thought of as being disposed at three different elevations. As used herein, the elevation of a region refers to its distance from a reference plane. For convenience, the reference plane is horizontal and the elevational distance from the reference plane is vertical. The elevation of a particular region of the paper web W according to the present invention may be measured using any non-contacting measurement device suitable for such purpose as is well known in the art. A particularly suitable measuring device is a non-contacting Laser Displacement Sensor having a beam size of 0.3×1.2 millimeters at a range of 50 millimeters. Suitable non-contacting Laser Displacement Sensors are sold by the Idec Company as models MX1A/B. Alternatively, a contacting stylis gauge, as is known in the art, may be utilized to measure the different elevations. Such a stylis gauge is described in commonly assigned U.S. Pat. No. 4,300,981 issued to Carstens and incorporated herein by reference.

The paper web W according to the present invention is placed on the reference plane with the imprinted region 22 in contact with the reference plane. The domes and synclines 118 extend vertically away from the reference plane. In this arrangement, the vertices 35 of the synclines 118 will be disposed intermediate the domes 24 and the imprinted region 22.

Optionally, the paper web W according to the present invention may be foreshortened. The optional foreshortening may be accomplished by creping or by wet microcontraction. Creping and wet microcontraction are disclosed in commonly assigned U.S. Pat. No. 4,440,597, issued to Wells et al. and U.S. Pat. No. 4,191,756, issued to Sawdai, the disclosures of which patents are incorporated herein by reference. Foreshortening the paper web W may make it more desirable to use anisotropically arranged synclines 118, as discussed above. Of course, the paper web W made according to the present invention is typically not foreshortened at all.

It will be recognized that several variations in the paper web W according to the present invention are feasible. For example, the resulting paper web W may be embossed as is well known in the art. One or more plies of the paper web W may be joined together to make a laminate, corrugated product, etc. Furthermore, the paper web W made according to the present invention may be air laid or otherwise made with less water than occurs in conventional wet laid systems commonly known in the art.

While the foregoing cellulosic structures, particularly hard grades of paper web W, have been described in terms of density and basis weight, it is to be recognized that the three region structures may be described in terms of other properties as well. For example, intensive properties such as opacity, absorbency and caliper may be executed in the same manner as described above with respect to density and basis weight. Furthermore, the invention may be applied to other sheet goods, such as nonwoven materials, tissue grades of paper web W, dryer-added fabric softeners, topsheets/ backsheets for disposable absorbent articles such as diapers and sanitary napkins, etc.

Furthermore, variations in the papermaking belt 25 are feasible. For example, the synclines 118 could be made by having translucent or other such lines 46 in the mask 120 which have a transparency/opaqueness intermediate that of the first regions 42 and the second regions 44 of the mask 120. For example, instead of opaque lines 46 in the mask 120, the synclines 118 may be formed by regions which have an intermediate gray level and allow limited penetration of the incident radiation R.

Other variations are also feasible. For example, a particular papermaking belt 25 may have two or more pluralities of synclines 118. A first plurality of synclines 118 may have a first depth 30 and/or width. A second plurality of synclines 118 may have a second depth 30 and/or width, etc. The pitch, amplitude and even the existence of the undulations may vary within a given papermaking belt 25.

In yet another variation, to reduce the air entrainment, noted above, the backside of the papermaking belt 25 may be provided with grooves. Preferably, the grooves are generally parallel the machine direction, although other orientations may be used as desired. For such an embodiment to occur, one of skill may cast the framework 112 onto the backside of the belt 25. The grooves, or any other desired patterns, are cast into this framework 112. While the framework 112 extends outwardly from the backside of the belt 25, it may also extend to a position coincident, or below, the paper web W contacting surface of the papermaking belt 25.

If desired, the belt 25 may be cast once on each face, providing mutually different framework 112 surfaces on the paper web W-contacting side and backside of the belt 25.

Referring back to FIGS. 1 and 2, the papermaking machine 20, one of ordinary skill will recognize the benefits of the claimed invention are even greater than described above. Referring back to FIG. 1, it is to be recognized that a single-wire draw paper machine may employ a plurality of wires. Each fabric is spaced apart in the machine direction from a preceding fabric. The present invention allows the capability to utilize different frameworks 112 at different fabric positions. For example, in a single-wire draw papermaking machine 20, belts 25 of successively decreasing paper web W-contacting surface area may be provided in the machine direction. This arrangement provides the benefit that a more uniform contact surface is presented to the paper web W while it is in its embryonic state and the fibers are more susceptible to imprinting and hence non-uniform characteristics. A higher permeability papermaking belt 25 may be provided later in the papermaking process providing the advantages of less air entrainment and increased flow area for water to be expressed through the belt 25.

Referring back to FIG. 2, in a twin-wire draw papermaking machine 20, different papermaking belts 25 may be simultaneously employed in opposed runs of the machine. For example, one may desire to imprint a different pattern on different sides of the paper web W. One papermaking belt 25 may be utilized with the upper row of drying cylinders 32 and a different papermaking belt 25 utilized with the lower row of drying cylinders 32. This arrangement provides increased flexibility and versatility not previously attainable with the prior art. For example, unmatched patterns in the framework 112 minimize imprinting of the paper web W. Imprinting may be further minimized using a belt 25 having a random pattern framework 112. Such a variation may be combined with those noted above so that a twin-wire draw papermaking machine 20 having different belts 25 for different banks of drying cylinders 32 and different belts 25 in the machine direction may be utilized for even more versatility.

If desired, the papermaking belt 25 having the framework 112 according to the present invention may be used as a forming wire. This arrangement provides the benefit that the framework 112 may be used to produce a watermark when hard grades of paper web W are being provided. The resin, or other material forming the framework 112, serves the dual functions of preventing flow of the furnish through that portion of the papermaking belt 25 coincident the framework 112, as well as providing an imprinting surface for producing the watermark while the paper web W is still in an embryonic state.

As noted above, the framework 112 may extend outwardly from the surface of the reinforcing element 114. In such a geometry, the framework 112 will imprint the paper web W as described above. Alternatively, the framework 112 may have one or more proximal ends juxtaposed with the backside of the papermaking belt 25. The framework 112 may extend upwardly towards the paper-contacting side of the papermaking belt 25 terminating in distal ends disposed between the backside and topside of the papermaking belt 25. Alternatively, the proximal end of the framework 112 may be disposed intermediate the topside and backside of the papermaking belt 25 as well. Such embodiments are illustrated and described in the commonly assigned, aforementioned and incorporated U.S. Pat. No. 6,110,324.

Conversely, a fabric earlier in the papermaking process may be provided with a greater open area in the deflection conduits 116. This allows for a higher rate of water removal. Fabrics which occur later in the papermaking process may have a greater area of the framework 112 associated with the top of the papermaking belt 25. This allows for more contact of the paper web W to occur against the drying cylinders 32, thereby increasing contact and thermal conduction. It will be recognized that any number of arrangements are feasible with the present invention, wherein a plurality of different drying fabrics are employed.

Of course, the papermaking belts 25 according to the present invention may be intermixed with papermaking belts 25 according to the prior art as well.

If desired, the papermaking belt 25 may have batting added thereto, as is commonly known for felt drying. If batting is selected to be added to the papermaking belt 25, the framework 112 may be applied to the topside of the batting of the papermaking belt 25. A removable curable material may be backfilled to the desired elevation starting from the backside of the belt 25 to prevent curing of the resin forming the framework 112 below the desired elevation. Backfilling is disclosed in commonly assigned U.S. Pat. No. 5,629,052, iss. May 13, 1997 to Trokhan et al. and U.S. Pat. No. 5,674,663, iss. Oct. 7, 1997 to McFarland et al., which patents are incorporated herein by reference.

Of course, in addition to imprinting the paper web W, and providing multi-density paper web W, the framework 112 increases the wear resistance of the papermaking fabric. Thus, the benefits cited above of increased life for the papermaking belt 25 occur due to the framework 112 providing resistance to abrasion and friction. As the amount of surface area of the framework 112 disposed on the backside of the papermaking belt 25 increases, the resistance to friction and wear increases in an inversely proportional relationship.

If desired, the framework 112 may be applied below the bottom surface of the optional batting. This arrangement provides the benefit of the improved wear resistance noted above. To achieve such an arrangement with the framework 112 extending outwardly from the backside of the papermaking belt 25, the belt 25 is inverted from the casting position described above and the optional backfill applied through the top surface of the belt 25. Of course, it will be apparent to one of ordinary skill that a first pattern may be applied to the backside of the belt 25 for improved wear resistance and a second pattern may be applied to the topside of the belt 25 for imprinting onto the paper web W. While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. A papermaking belt for use in making paper, said papermaking belt having mutually opposed faces, a paper-contacting face having a surface area and a machine-contacting face, said papermaking belt comprising a reinforcing element of woven filaments;

said papermaking belt further having a framework including a photosensitive resin, said framework having a pattern independent of said reinforcing element, said pattern of said framework defining at least one of a first face and a second face, wherein said first face of said framework is substantially macroscopically monoplanar and provides at least 90% of said surface area of said paper-contacting face of said belt.

2. The papermaking belt of claim 1, wherein said pattern comprises an essentially continuous network.

3. The papermaking belt of claim 1, wherein said first face of said framework extends outwardly from said reinforcing element a distance of at least 1 millimeter.

4. The papermaking belt of claim 1, wherein said first face of said framework of said papermaking belt is coincident said reinforcing element.

5. A papermaking machine for making paper thereon in combination with a papermaking belt for carrying a nascent paper web, said papermaking belt having mutually opposed faces, a paper-contacting face having a surface area and a machine-contacting face, said papermaking belt comprising a reinforcing element of woven filaments;

said papermaking belt further having a framework including a photosensitive resin, said framework having a pattern independent of said reinforcing element, said pattern of said framework defining at least one of a first face and a second face, wherein said first face of said framework is substantially macroscopically monoplanar and provides at least 90% of said surface area of said paper-contacting face of said belt.

6. The paper machine of claim 5, wherein said paper machine comprises a single-wire draw paper machine.

7. The paper machine of claim 5, wherein said paper machine comprises a twin-wire draw paper machine.

8. A single-wire draw paper machine for making paper in combination with a papermaking belt for carrying a nascent paper web, said papermaking machine comprising at least two belts, each said belt having mutually opposed faces, a paper-contacting face and a machine-contacting face, each said belt comprising a reinforcing element of woven filaments and having a patterned framework thereon, said framework having a pattern independent of said reinforcing element, said pattern of said framework defining at least one of a first face and a second face; and wherein said two belts each have a mutually different pattern in said framework.

9. A twin-wire draw paper machine for making paper in combination with a papermaking belt for carrying a nascent paper web, said papermaking machine comprising at least two belts, each said belt having mutually opposed faces, a paper-contacting face and a machine-contacting face, each said belt comprising a reinforcing element of woven filaments and having a patterned framework thereon, said framework having a pattern independent of said reinforcing element, said pattern of said framework defining at least one of a first face and a second face; and wherein said two belts each have a mutually different pattern in said framework.

* * * * *